US005690751A

United States Patent [19]

Hösel et al.

[11] Patent Number: 5,690,751

[45] Date of Patent: Nov. 25, 1997

[54] VAPOR PHASE CLEANING

[75] Inventors: Peter Hösel, Pforzheim; Wolfgang Müller, Mühlacker, both of Germany; Hans-Norbert Adams; Werner Baggenstoss, both of Richterswil, Switzerland

[73] Assignees: The Dow Chemical Company, Midland, Mich.; EMO Oberflachentechnik GmbH, Bretten-Golshausen, Germany

[21] Appl. No.: 605,013

[22] PCT Filed: Aug. 29, 1994

[86] PCT No.: PCT/EP94/02847

§ 371 Date: Feb. 28, 1996

§ 102(e) Date: Feb. 28, 1996

[87] PCT Pub. No.: WO95/06762

PCT Pub. Date: Mar. 9, 1995

[30] Foreign Application Priority Data

Aug. 30, 1993 [DE] Germany ..... 43 29 178.3

[51] Int. Cl.[6] ..... B08B 3/00; B08B 5/00

[52] U.S. Cl. ..... 134/30; 134/31

[58] Field of Search ..... 134/11, 31, 10, 134/21, 40, 26, 30

[56] References Cited

U.S. PATENT DOCUMENTS

| | | | |
|---|---|---|---|
| 4,303,454 | 12/1981 | Petterson et al. | 134/11 |
| 5,045,117 | 9/1991 | Withere, II | 134/21 |
| 5,051,135 | 9/1991 | Tanaka et al. | 134/10 |
| 5,081,772 | 1/1992 | Wyman | 34/79 |
| 5,108,660 | 4/1992 | Michael | 134/34 |
| 5,115,576 | 5/1992 | Robertson, Jr. et al. | 34/15 |
| 5,137,581 | 8/1992 | Takahashi | 134/21 |
| 5,240,507 | 8/1993 | Gray et al. | 134/21 |

FOREIGN PATENT DOCUMENTS

| | | |
|---|---|---|
| 0381887 | 8/1990 | European Pat. Off. . |
| 0581113 | 2/1994 | European Pat. Off. . |
| 3738006 | 5/1989 | Germany . |
| 4031563 | 4/1992 | Germany . |
| 4128699 | 3/1993 | Germany . |
| 3026383 | 2/1991 | Japan . |
| 3101881 | 4/1991 | Japan . |
| 753500 | 8/1980 | U.S.S.R. . |
| 8904234 | 5/1989 | WIPO . |
| 9308933 | 5/1993 | WIPO . |

OTHER PUBLICATIONS

Catalog of the Aldrich Chemical Company, Inc, 1992, p. 355.

Handbook of Organic Solvents, Lide, CRC Press, 1995, pp. 21, 106, 107.

Database WPI, Week 9436, Derwent Publications Ltd., London, GB; AN 94–291341 (1994).

Derwent 90–264870/35 (1989).

*Primary Examiner*—Jill Warden
*Assistant Examiner*—Alexander Markoff

[57] ABSTRACT

In a process for cleaning one or more articles in the vapor phase of an organic solvent the solvent vapor is fed into a cleaning chamber (1) wherein an absolute pressure of 200 mbar or less is maintained and the cleaning is conducted at a temperature at or above the flash point of the organic solvent. A preferred apparatus for conducting the cleaning process contains a cleaning chamber (1), two storage tanks (2 and 3), an evaporator (4), a heating device (5) and a condenser (6). These devices are connected by means of a conduit system which is equipped with a vacuum pump (7), two pumps (8 and 9) and valves (12, 13, 14, 15, 16, 17, 18, 19, 20, 21 and 22). Inlet air (11) can be fed into the cleaning chamber (1). Waste gas (10) can be removed from the apparatus by means of the vacuum pump (7).

20 Claims, 1 Drawing Sheet

VAPOR PHASE CLEANING

The present invention relates to the cleaning of one or more articles in the vapor phase of an organic solvent. This cleaning method is generally known as "vapor degreasing" and is often used for degreasing articles, such as metals, glass or plastic, etc.. In vapor degreasing processes the article to be cleaned is placed in a zone of solvent vapor. The surface of the article has a lower temperature than the solvent vapor. The vapor condenses on the article and subjects its surface to a solvent-flushing action as it flows downward. The liquid drops are collected and revaporized. Thus, the surface of the article is continually rinsed with distilled solvent until at least the surface of the article has the same temperature as the solvent vapor and condensation ceases. Very effective cleaning of the surface of the article is achieved. Typically halogenated solvents, such as perchloroethylene, trichloroethylene, 1,1,1 -trichloroethane or methylene chloride are used. However, for environmental reasons the use of halogenated solvents becomes less and less desirable in spite of their many good properties, such as excellent cleaning efficiency, non-flammability etc.. Much research is being spent on the replacement of chlorinated solvents by environmentally more friendly solvents. However, the utility of other solvents is limited because many halogen-free solvents have a flash point and, accordingly, are a substantial explosion and fire hazard.

Accordingly, one object of the present invention is to provide an efficient process for cleaning articles wherein halogen-free solvents can be used but wherein a substantial explosion hazard can be avoided. Another object of the present invention is to provide such a cleaning process wherein a substantial explosion hazard can be avoided by other means than expensive explosion proof installations or the use of inert gases.

It has been found that a substantial explosion hazard can be avoided when a vapor phase cleaning is conducted in an apparatus wherein an absolute pressure of 200 mbar or less is maintained.

EP-A-0,381,887 describes a process, wherein freon or trichloroethylene is used as a solvent. A decreased pressure is recommended in the cleaning tank, such that no solvent vapor is released from the cleaning tank. However, the use of halogenated solvents is undesirable for the above-mentioned reasons.

WO-A-93/08933 relates to a process wherein an object to be cleaned is placed in a chamber and the chamber is evacuated in order to remove air and other non-condensible gases, before a solvent is introduced to the chamber. The chamber is evacuated in order to prevent that solvent is mixed with air and has to be separated from air at a later stage. The vacuum pump is then shut off. When solvent is introduced into the chamber, the pressure in the chamber increases. Aldehydes, alcohols, amines, ketones and aromatic solvents are mentioned in addition to halogenated solvents. However, it is not indicated how to avoid an explosion hazard when such solvents are used.

Accordingly, one aspect of the present invention is a process for cleaning one or more articles in the vapor phase of an organic solvent, which process is characterized in that solvent vapor is fed into a cleaning chamber wherein an absolute pressure of 200 mbar or less is maintained and the cleaning is conducted at a temperature at or above the flash point of the organic solvent.

Another aspect of the present invention is an apparatus for conducting the process of the present invention which comprises a cleaning chamber, an evaporator and a vacuum pump.

BRIEF DESCRIPTION OF THE DRAWINGS

The sole FIGURE is a schematic illustration of a preferred embodiment of the apparatus of the invention.

It has been found that according to the process of the present invention one or more articles can be safely cleaned in the vapor phase of an organic solvent, even when the cleaning is conducted at a temperature at or above the flash point of the organic solvent. For the sake of convenience, the following description relates to the cleaning of "articles" although the process of the present invention is not limited to the cleaning of several articles but is equally useful for cleaning a single article. The flash point of an organic solvent is generally measured at atmospheric pressure. The flash point as defined herein means the lowest temperature of the solvent at which the mixture of solvent vapor and air above the solvent can be ignited according to standard procedures according to DIN 51755, DIN 51758 or DIN 53213. In the event of an explosion of the organic solvent the resulting pressure is not more than about 8 times the original pressure in the cleaning chamber. By maintaining an absolute pressure of 200 mbar or less, preferably of 125 mbar or less, more preferably of 100 mbar or less in the cleaning chamber it is not necessary to conduct the cleaning in an expensive apparatus which withstands high pressures or which contains expensive explosion proof instrumentation. For economical reasons the cleaning process of the present invention is conducted in such a manner the absolute pressure in the cleaning chamber generally is not less than 1 mbar, preferably not less than 10 mbar and most preferably not less than 40 mbar. By the indicated pressure is meant the prevailing pressure during the vapor phase cleaning operation.

Figure 1:
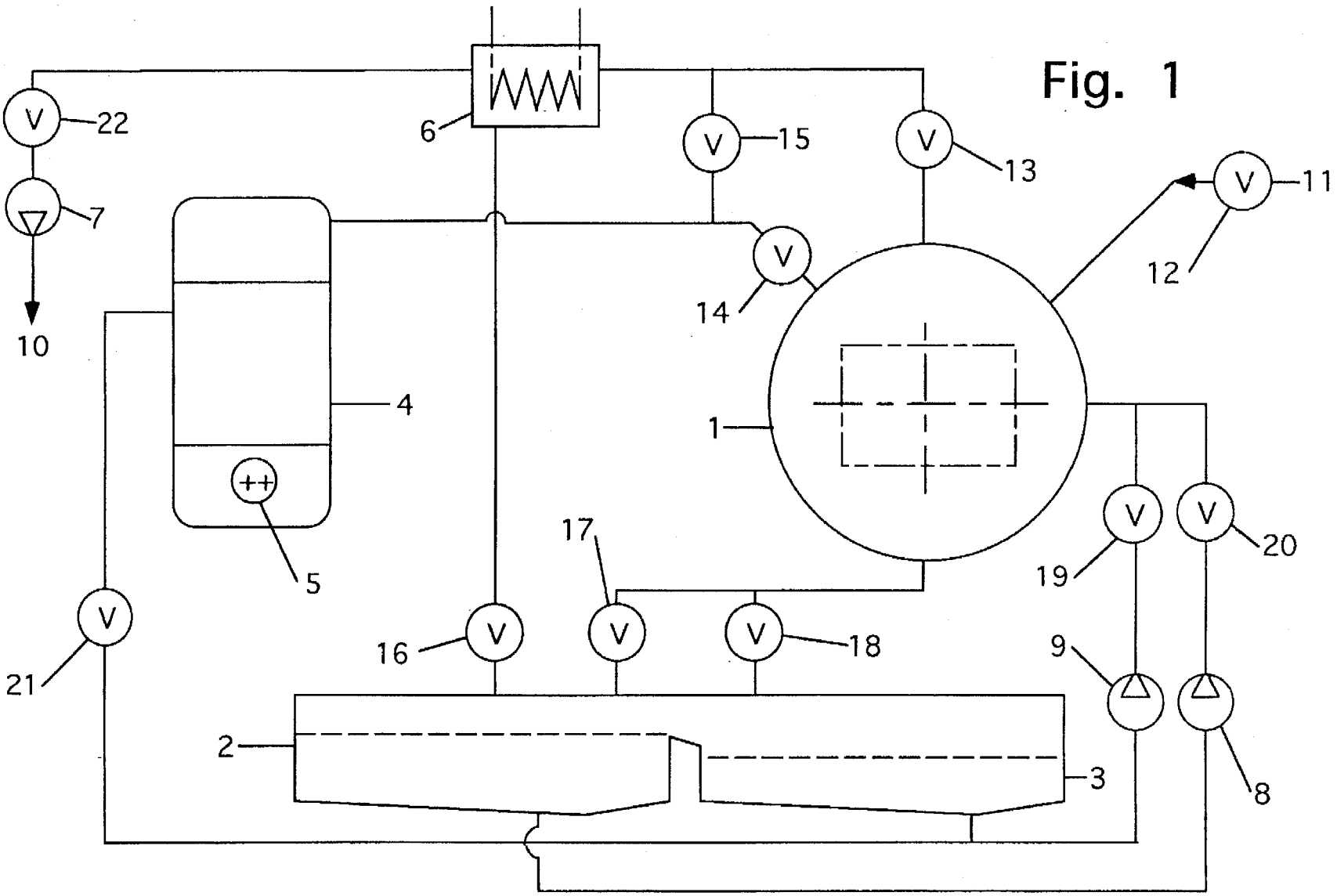

In addition to the described safety advantages, it was found that by the process of the present invention very clean articles can be obtained and the cleaned articles can be dried rapidly and thoroughly in a very efficient way. In order to achieve most efficient cleaning and subsequent drying of the articles, it is essential to clean the articles at a temperature at or above the flash point of the organic solvent. If the temperature is too low, cleaning is less efficient and an incomplete drying results or the drying of the cleaned articles lasts undesirably long. Within the given pressure limits the process of the present invention is preferably conducted at a temperature of at least 10° C., more preferably at least 20° C. above the flash point of the organic solvent. Preferably, the process of the present invention is conducted at a temperature up to 120° C., more preferably up to 100° C., most preferably up to 80° C.

At least some of the cleaning in the cleaning process of the present invention is conducted in the vapor phase of an organic solvent. The term "an organic solvent" as used herein encompasses undiluted organic compounds as well as mixtures of two or more organic compounds which are generally designated in the art as organic solvents and also mixtures of one of more such organic compounds with water. If a solvent mixture is used, the mixture preferably contains more than 50%, more preferably more than 70%, most preferably more than 95% of non-halogenated organic solvents, based on the total weight of the mixture. Most preferably, an entirely halogen-free organic solvent is used for cleaning. If the used solvent mixture contains water, it preferably contains less than 80%, more preferably less than 50%, most preferably less than 30% water, based on the total weight of the mixture. The cleaning process of the present invention is particularly useful for an organic solvent which has a flash point which is lower than its boiling point at atmospheric pressure and which has a boiling point of 100° C. or less at an absolute pressure of 1 mbar or more. Preferred are aliphatic hydrocarbons containing from 5 to 15 carbon atoms, such as cyclic saturated hydrocarbons and linear or branched saturated or unsaturated hydrocarbons, preferably cycloalkanes, n-paraffins, isoparaffins or Stoddard solvent, or aromatic hydrocarbons, such as toluene or xylene, or oxygen-containing organic compound, such as alcohols, preferably isopropanol, esters, preferably alkyl lactates or dibasic esters, such as commercially available mixtures of dibasic esters, ethers, preferably diethyl ether, ketones, preferably acetone or methyl ethyl ketone, or hydroxyethers, preferably alkoxy propanols or alkoxy ethanols, cyclic siloxanes containing preferably 6 to 8 ring atoms or a mixture of two or more of such compounds. The solvents which are most preferably used in the process of the present invention have flash points in the range from 10° C. to 100° C., preferably from 40° C. to 100° C.

In the practice of cleaning articles in a cleaning chamber in the vapor phase of an organic solvent, the entire procedure usually comprises the following steps:

a) loading the cleaning chamber with the articles to be cleaned and closing the cleaning chamber;

b) optionally regulating the pressure in the cleaning chamber to 200 mbar or lower, more preferably to 125 mbar or lower, most preferably to 100 mbar or lower and prepurifying the articles with a liquid solvent;

c) reducing the pressure in the cleaning chamber to 200 mbar or lower, more preferably to 125 mbar or lower, most preferably to 100 mbar or lower;

d) feeding solvent vapor to the evacuated cleaning chamber whereby not exceeding an absolute pressure of 200 mbar in the cleaning chamber and cleaning the articles by condensation of solvent vapor on the articles;

e) reducing the solvent vapor concentration in the cleaning chamber and drying the cleaned articles and;

f) increasing the pressure in the cleaning chamber and unloading the cleaning chamber.

Step a) can be conducted in a known manner. The articles can for example be placed in containers such as baskets etc..

Step b) is optional and can also be conducted in a known manner. Vacuum pumps for achieving the desired pressure reduction are known in the art and not described in more detail herein. For prepurifying the articles, the cleaning chamber is preferably flooded with a liquid solvent. In a preferred method of flooding the cleaning chamber liquid solvent is pumped from a storage tank into the cleaning chamber. After having cleaned the articles, the solvent is preferably returned from the cleaning chamber to the storage tank. If desired, the steps of flooding the cleaning chamber with liquid solvent, cleaning the articles and removing liquid solvent from the cleaning chamber can be repeated once or more. In this case preferably fresh liquid solvent is fed from another storage tank to the cleaning chamber. Pumps for filling and emptying the cleaning chamber are known in the art. If the pressure reached in step b) is higher than 125 mbar, the temperature of the liquid solvent is preferably regulated that it is at least 15° C. lower than the flash point of the solvent. Generally, the temperature of the liquid solvent which is fed into the cleaning chamber is at least 10° C. lower than, preferably at least 20° C. lower than the temperature of the solvent vapor which is fed into the cleaning chamber in step d). As indicated above, the prepurifying with liquid solvent is optional. When the articles are prepurified with liquid solvent, it is generally advisable to adjust the pressure in the cleaning chamber in two steps, i.e. prior to and after the prepurifying. When no prepurifying step is conducted, the cleaning chamber can generally be evacuated in a single step prior to feeding of solvent vapor into the cleaning chamber.

The evacuation procedure in step c) can be conducted in a known manner). The desired final absolute pressure in the cleaning chamber prior to feeding the solvent vapor is equal to or less than the absolute pressure of the vapor which is fed into the cleaning chamber in step d).

In the vapor phase cleaning step d) solvent vapor is fed into the cleaning chamber wherein the absolute pressure does not exceed 200 mbar, preferably not 125 mbar, more preferably not 100 mbar. Preferably, the solvent vapor is generated in an evaporator and fed to the cleaning chamber. Preferably, the absolute pressure in the evaporator is equal to or higher than the pressure in the cleaning chamber prior to feeding of the solvent vapor. However, the absolute pressure in the evaporator does not exceed 200 mbar, preferably not 125 mbar, most preferably not 100 mbar. Preferably, the solvent vapor has a temperature at or above the flash point of the organic solvent which is used. The articles to be cleaned generally have an initial temperature that is lower than the temperature of the solvent vapor. Preferably, they have a temperature between room temperature and 10° C. below the temperature of the solvent vapor, more preferably between room temperature and 20° C. below the temperature of the solvent vapor. This lower temperature causes condensation of at least a portion of the solvent vapor on the surface of the articles. Usually the temperature of the articles increases during the vapor phase cleaning, depending on the heat transfer between the vapor phase and the articles. Upon completion of the vapor phase cleaning step d) at least the surface of the articles generally has about the same temperature as the solvent vapor. Excess solvent vapor can be removed from the cleaning chamber and can for example be condensed in a condenser in a known manner. The condensed solvent can be recovered and further processed. For example, condensed solvent vapor can be transferred into the evaporator or into one or more storage tanks for further usage. The cleaning step d) is generally completed within 30 minutes, typically within 5 minutes and in most cases even within 3 minutes.

After the vapor phase cleaning step d) the cleaned articles are generally subjected to a drying operation. The pressure in the cleaning chamber is advantageously reduced. The pressure during the drying step preferably is ½, more preferably ⅕, most preferably 1/10 of the pressure that is maintained during the cleaning step d). The pressure reduction facilitates rapid evaporation of excess condensed solvent which adheres to the surface of the cleaned articles. It has been found that the drying is even more efficient if the pressure reduction is performed very rapidly, e.g. by rapid opening of a connection, such as a valve, between the cleaning chamber and an evacuated container. The decreased solvent vapor pressure also avoids undesirably high solvent emissions during unloading of the cleaning chamber. The removed solvent vapors can for example be condensed in a condenser and/or adsorbed in a known manner. The condensed and/or adsorbed solvent can be recovered and further processed. For example, condensed solvent vapor can be transferred into the evaporator or into one or more storage tank(s) for further usage.

The apparatus for conducting the process of the present invention comprises a cleaning chamber, an evaporator and a vacuum pump. The cleaning chamber and evaporator should be evacuable, i.e. they should be construed in such a manner that they can be evacuated. The evaporator serves for heating the organic solvent to generate solvent vapor under reduced pressure. The vacuum pump serves for evacuating the cleaning chamber and the evaporator. Advantageously, the apparatus of the present invention also comprises a condenser. One function of the condenser is the condensation of excess solvent which is removed from the cleaning chamber in the above-described vapor phase cleaning step d) and/or drying step e). An optional alternative function of the condenser in combination with the evaporator is the distillation of the organic solvent. A preferred embodiment of the apparatus additionally comprises one or more storage tanks for liquid solvent. The storage tank(s) should be evacuable, i.e. they should be construed in such a manner that they can be evacuated. The storage tank(s) can be connected with the cleaning chamber in a known way. Preferably, the condenser, if present, is also connected with the storage tanks(s). The presence of a storage tank allows prepurifying of the articles with liquid solvent and collection of condensed solvent from the condenser and/or from the cleaning chamber. The apparatus also contains a conduit system equipped with valves which is not discussed in detail.

A preferred embodiment of the process and of the apparatus of the present invention are described in more detail with reference to the drawing. The drawing is a schematic illustration of a preferred embodiment of the apparatus of the present invention.

The apparatus contains a cleaning chamber 1, two storage tanks 2 and 3, an evaporator 4, a heating device 5 and a condenser 6. They are connected by means of a conduit system which is equipped with a vacuum pump 7, two pumps 8 and 9 and valves 12, 13, 14, 15, 16, 17, 18, 19, 20, 21 and 22. Inlet air 11 can be fed into the cleaning chamber 1. Waste gas 10 can be removed from the apparatus by means of the vacuum pump 7.

Before the cleaning apparatus is ready for operation, liquid solvent is filled into the evaporator 4. All valves are closed. Then valves 13, 15, 17 and 22 are opened for evacuating the entire apparatus, e.g. by means of the vacuum pump 7. When the desired pressure is reached, distillation of the liquid solvent in the evaporator 4 is started. Valves 13 and 17 are closed and valves 15 and 16 are opened. The heating device 5 is set into operation for evaporating the solvent. The solvent vapor is transmitted to the condenser 6. The condensed solvent flows into the storage tank 2. The overflow of the storage tank 2 flows into the storage tank 3. If needed the evaporator is fed with liquid solvent from the storage tank 3; for this purpose valve 21 is opened and closed as needed. During the distillation the pressure in the cleaning apparatus can be controlled by means of the vacuum pump 7 and alternating opening and closing of valve 22.

The cleaning apparatus is then ready for operation. Valve 12 is opened and inlet air 11 is fed into the cleaning chamber 1 until atmospheric pressure is reached in the cleaning chamber. In a first step a) the cleaning chamber is opened, loaded with articles to be cleaned and closed again. In a second step b) valve 12 is closed and valves 13 and 22 are opened for evacuating the cleaning chamber to the desired pressure by means of the vacuum pump 7. In the prepurifying step c) valve 19 is opened and liquid solvent is pumped from the storage tank 3 into the cleaning chamber 1 by means of pump 9. The efficiency of the cleaning with liquid solvent can be increased by mechanical agitation of the objects and/or generating ultrasonic waves in the cleaning chamber. Valve 19 is closed. When this washing procedure is finished valve 18 is opened and the contaminated liquid solvent is transmitted into the storage tank 3. The contaminated liquid solvent can be fed into the evaporator 4 which is still operating. Valve 18 is closed. In order to perform a second cleaning operation with liquid solvent, valve 20 is opened and liquid solvent is pumped from the storage tank 2 into the cleaning chamber 1 by means of pump 8. Valve 20 is closed. When the second washing procedure is finished valve 17 is opened and the contaminated liquid solvent is transmitted into the storage tank 2 from where it overflows into the storage tank 3. During and after the prepurifying step c) the pressure in the cleaning chamber 1 can be controlled by means of the vacuum pump 7 and alternating opening and closing of the valve 22. During steps a)-c) described above the distillation of liquid solvent in the evaporator 4 continues.

In order to start the vapor phase cleaning step d), valves 15 and 17 are closed and valve 14 is opened. The distillation of liquid solvent is thereby interrupted. Via the opened valve 14 solvent vapor is fed into the cleaning chamber where it condenses on the articles until their surface reaches the temperature of the solvent vapor. Valve 14 is then closed and valves 15 and 17 are opened. Condensed solvent flows into the storage tank 2.

Prior to the drying step e) valves 15, 16 and 17 are closed. The pressure in the cleaning chamber 1 is further lowered by means of the vacuum pump 7 and alternating opening and closing of the valve 22. Thereby the cleaned articles are dried. After the drying step e) the pressure in the cleaning chamber is adjusted to the pressure in the other parts of the cleaning apparatus by closing valve 22 and feeding a controlled amount of fresh air into the cleaning chamber via valve 12. Then valves 15 and 16 are opened to continue the distillation of liquid solvent. Valve 22 is opened and closed as needed to maintain the desired pressure in the cleaning apparatus.

In step f) valve 13 is closed and valve 12 is opened again. The pressure in the cleaning chamber is thereby increased to atmospheric pressure. The cleaning chamber is opened for unloading. Then a new cleaning cycle can be started at step a) above.

What is claimed is:

1. A process for cleaning one or more articles in the vapor phase of an organic solvent having a flash point of from 40° C. to 100° C., comprising the steps of feeding solvent vapor into a cleaning chamber, wherein an absolute pressure of 200 mbar or less is maintained, and cleaning of said one or more articles at a temperature at or above the flash point of the organic solvent and a pressure of 200 mbar or less.

2. The process of claim 1, wherein an absolute pressure of 125 mbar or less is maintained in the cleaning chamber.

3. The process of claim 1, wherein the organic solvent contains more than 50%, based on the total weight of the organic solvent, of an aliphatic hydrocarbon containing 5 to 15 carbon atoms, an aromatic hydrocarbon, an oxygen-containing organic compound, a cyclic siloxane or a mixture of two or more of such compounds.

4. The process of claim 2, wherein the organic solvent contains more than 50%, based on the total weight of the organic solvent, of an aliphatic hydrocarbon containing 5 to 15 carbon atoms, an aromatic hydrocarbon, an oxygen-containing organic compound, a cyclic siloxane or a mixture of two or more of such compounds.

5. The process of claim 3, wherein the organic solvent contains more than 50% of an alkoxy propanol or a mixture of two or more alkoxy propanols, based on the total weight of the organic solvent.

6. The process of claim 4, wherein the organic solvent contains more than 50% of an alkoxy propanol or a mixture of two or more alkoxy propanols, based on the total weight of the organic solvent.

7. The process of claim 1, wherein the organic solvent is halogen-free.

8. The process of claim 2, wherein the organic solvent is halogen-free.

9. The process of claim 3, wherein the organic solvent is halogen-free.

10. The process of claim 1, wherein the organic solvent is a solvent mixture containing less than 50% of water, based on the total weight of the solvent mixture.

11. The process of claim 3, wherein the organic solvent is a solvent mixture containing less than 50% of water, based on the total weight of the solvent mixture.

12. The process of claim 9, wherein the organic solvent is a solvent mixture containing less than 50% of water, based on the total weight of the solvent mixture.

13. The process of claim 10, wherein the water content in the solvent mixture is less than 30%.

14. The process of claim 12, wherein the water content in the solvent mixture is less than 30%.

15. The process of claim 1, wherein said one ore more articles are pre-cleaned with a liquid solvent having a flash point of from 40° C. to 100° C. at a pressure of 200 mbar or less.

16. The process of claim 9, wherein said one ore more articles are pre-cleaned with a liquid solvent having a flash point of from 40° C. to 100° C. at a pressure of 200 mbar or less.

17. The process of claim 15, wherein said one or more articles are pre-cleaned with the liquid solvent at a pressure of 125 mbar or less.

18. The process of claim 16, wherein said one or more articles are pre-cleaned with the liquid solvent at a pressure of 125 mbar or less.

19. The process of claim 1, wherein after said cleaning step said one or more articles are subjected to a drying operation wherein the absolute pressure in the cleaning chamber is reduced to ½ or less of the pressure maintained during the cleaning step.

20. The process of claim 9, wherein after said cleaning step said one or more articles are subjected to a drying operation wherein the absolute pressure in the cleaning chamber is reduced to ½ or less of the pressure maintained during the cleaning step.

* * * * *